US005270768A

United States Patent [19]

Murata

[11] Patent Number: 5,270,768

[45] Date of Patent: Dec. 14, 1993

[54] CHARGING MEMBER CONTAINING REDUCED TITANIUM OXIDE AND DEVICE USING SAME

[75] Inventor: Jun Murata, Kawagoe, Japan

[73] Assignee: Canon Kabushiki Kaisha, Tokyo, Japan

[21] Appl. No.: 871,547

[22] Filed: Apr. 21, 1992

[30] Foreign Application Priority Data

Apr. 24, 1991 [JP] Japan ..... 3-119010

[51] Int. Cl.[5] ..... G03G 15/02; G03G 21/00

[52] U.S. Cl. ..... 355/219

[58] Field of Search ..... 355/219, 227

[56] References Cited

U.S. PATENT DOCUMENTS

| | | | |
|---|---|---|---|
| 4,967,231 | 10/1990 | Hosoya et al. | 355/219 |
| 4,994,319 | 2/1991 | Nojima et al. | 428/335 |
| 5,008,706 | 4/1991 | Ohmori et al. | 355/219 |
| 5,089,851 | 2/1992 | Tanaka et al. | 355/219 |
| 5,126,913 | 6/1992 | Araya et al. | 355/219 X |
| 5,140,371 | 8/1992 | Ishihara et al. | 355/219 |

FOREIGN PATENT DOCUMENTS

| | | |
|---|---|---|
| 0328113 | 8/1989 | European Pat. Off. . |
| 0349072 | 1/1990 | European Pat. Off. . |
| 0387815 | 9/1990 | European Pat. Off. . |
| 0443229 | 8/1991 | European Pat. Off. . |
| 63-170673 | 7/1988 | Japan . |
| 2-127337 | 5/1990 | Japan . |
| 3-10267 | 1/1991 | Japan . |

*Primary Examiner*—Fred L. Braun

*Attorney, Agent, or Firm*—Fitzpatrick, Cella, Harper & Scinto

[57] ABSTRACT

A charging member for use in a device, such as an electrophotographic or facsimile device, includes at least inner and outer resistance layers formed on an electrically-conductive substrate. Electrically-conductive particles dispersed in the matrix of the outer resistance layer are reduced titanium oxide which is represented by the following general formula:

$TiO_n$ where n is a number not more than 1.9.

15 Claims, 3 Drawing Sheets

CHARGING MEMBER CONTAINING REDUCED TITANIUM OXIDE AND DEVICE USING SAME

BACKGROUND OF THE INVENTION

Field of the Invention

The present invention relates to a charging member for use in a device such as an electrophotographic device. More particularly, it pertains to a charging member which charges by bringing this member to which voltage is applied into contact with the surface of another member to be charged, and to a device using such a charging member.

Description of the Related Art

In image forming apparatuses, such as electrostatic recording devices, and electrophotographic devices, such as copying machines and optical printers, corona discharge devices have hitherto been widely employed to charge the surfaces of image carriers serving as members to be charged, such as photosensitive and dielectric members.

The corona discharge device is effective in uniformly charging the surface of a member to be charged, such as an image carrier, so that the member assumes a predetermined electrical potential. However, this device requires a high-voltage power supply and utilizes corona discharge, thus generating undesirable ozone.

As opposed to such a corona discharge device, a contact-type charging device has advantages in that the voltage of the power supply as well as the amount of ozone generated can be reduced. In such a charging device, a charging member to which voltage is applied is brought into contact with the surface of another member to be charged in order to charge it.

The above-mentioned charging member is composed of at least inner and outer electrical resistance layers formed on an electrically-conductive substrate. The outer resistance layer retains an appropriate surface resistance, and the inner resistance layer retains appropriate elasticity so as to provide an optimum nip-width with respect to the surface of the member to be charged. Such retention makes it possible to uniformly charge the member, such as a photosensitive member, and to prevent leakage caused by pinholes in and damage to the surface of the member.

Electrically-conductive particles, such as carbon black, graphite and metallic powder, are dispersed in an elastic material, such as rubber or resin, in order to provide the above resistance layers with electrical conductivity. However, when the electrically-conductive particles are dispersed in the outer resistance (outermost) layer, a resistance value in a semiconductive resistance region becomes unstable and is likely to vary from portion to portion of the layer.

When a small number of the electrically-conductive particles is added for dispersion thereof, the resistance value is decreased. Thus the proportion of a binder, such as resin or rubber, in the layers is increased. In general, as the proportion of the binder is increased, so is moisture absorption, although such proportions depend upon the material. The charging member absorbs a substantial amount of moisture at high humidity; consequently, the resistance value of the member is decreased. In such a case, if the charging member comes into contact with damaged portions or pinholes in the photosensitive member, the photosensitive member breaks down due to the leakage of the electric current.

To solve the above-noted problem, it is possible to effectively employ a solid solution-type metallic oxide having resistivity higher than that of the above electrically-conductive particles. This metallic oxide includes substances such as $SiO_2 \cdot Sb_2O_3$, $ZnO \cdot Al_2O_3$, $In_2O_3 \cdot SnO_2$, $TiO_2 \cdot Ta_2O_3$, and $Fe_2O_3 \cdot TiO_2$.

However, the color of these particles is either a white or pale color. When the particles are employed to form the charging member, the outer layer on the member shows as a shade of white or a pale color in accordance with the color of the particles. Thus, when such a charging member is used as a charging or transfer roller, a black or another colored toner adheres to the surface of the roller, thereby contaminating the surface.

SUMMARY OF THE INVENTION

The present invention has been made in view of the above-noted problems. An object of this invention is to provide a charging member in which the charge characteristics are excellent, the resistance thereof varies little and is substantially uniform, and breakdown due to electric current leakage does not occur, even if pinholes are formed in a photosensitive member. This charging member is not affected by environmental conditions, nor does it show become contaminated by the adhesion of toner or the like.

Another object of this invention is to provide an electrophotographic device using such a charging member.

A further object is to provide a charging member used for transfer charge. This charging member comprises at least two resistance layers formed on an electrically-conductive substrate with electrically-conductive particles dispersed in a matrix of an outer resistance layer composed of reduced titanium oxide represented by the following general formula:

$$TiO_n$$

where n is a number not more than 1.9.

In this invention, such titanium oxide is contained in the outer resistance layer of the charging member, whereby the resistance value does not vary and is stable in a semiconductive region, and the degree to which the charging member is affected by environmental conditions is minimized.

Therefore, irregular and poor charge does not occur. The charging member does not break down due to electric current leakage, even if it comes into contact with pinholes in the photosensitive member. These advantages are obtained in an environment where the temperature and relative humidity are low as well as high. The surface of a roller does not become contaminated by the adhesion of toner or the like even after long use of the charging member. When the charging member is used for transfer charge, the following advantages can be obtained.

DESCRIPTION OF THE PREFERRED EMBODIMENTS

Figure 1:
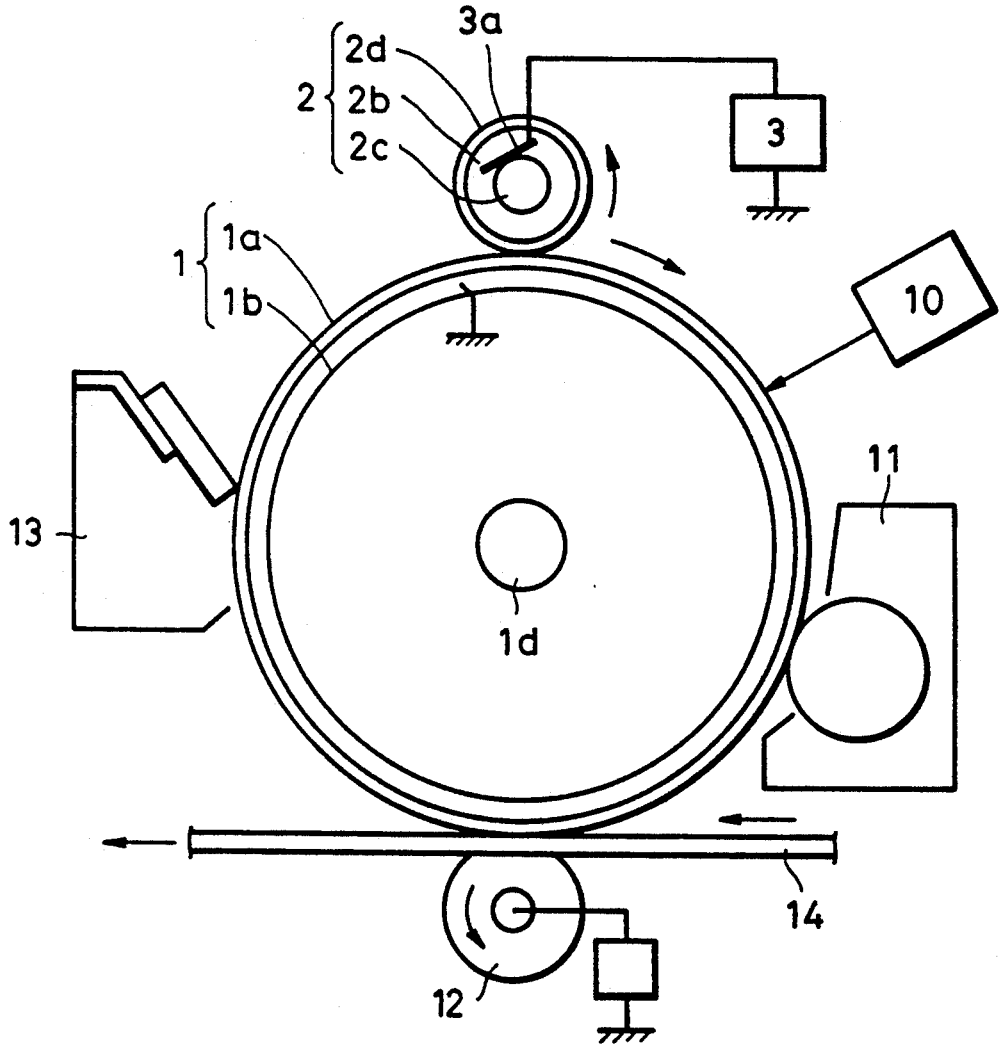
FIG. 1 is a schematic view showing the structure of a standard transfer type electrophotographic device using a charging member according to the present invention.

A charging member according to the present invention is composed of at least two resistance layers formed on an electrically-conductive substrate.

A substance having electrical conductivity and strength sufficient for use as a base can be used as the substrate. Preferably, the substrate is made of iron, stainless steel, aluminum, electrically-conductive plastic, etc. It is formed into various shapes, such as the shape of a roll, a blade, a block, a rod or a belt, as described later.

In this invention, at least two or more resistance layers are formed on the substrate. An outer resistance layer farthest from the substrate is formed by dispersing electrically-conductive particles in the matrix of the layer.

Reduced titanium oxide, obtained by reducing titanium dioxide, is used for the electrically-conductive particles and is represented by the following general formula:

$$TiO_n$$

where n is a number not more than 1.9.

In general, titanium oxide refers to titanium dioxide ($TiO_2$), shows as a shade of white, and has the electrical resistance of insulating materials. Also there is electrically-conductive titanium oxide which is obtained by coating titanium dioxide particles with an electrically-conductive substance, such as $SnO_2 \cdot Sb_2O_3$. It shows as a shade of a white or pale color.

Reduced titanium oxide which is obtained by reducing titanium dioxide and is employed in this invention manifests a shade from grayish blue to black depending upon the degree of the reduction. Reduced titanium oxide has electrical conductivity such that its resistivity ranges from approximately $10^0$ to $10^4$ $\Omega \cdot cm$ under a pressure of 100 $kg/cm^2$.

Thus, when titanium oxide is blended in the outer resistance layer, it manifests a shade of grayish blue or black. It is possible to form the outermost resistance layer such that it has stable resistance in a semiconductive resistance region.

The ratio of the number of atoms of titanium to the number of atoms of oxygen (Ti/0 ratio) in TiOn is preferably from 1:1.9 to 1:1. When the Ti/O ratio is less than 1:1.9, whiteness increases, and blackness decreases.

Of the TiOn, $Ti_mO_{2m-1}$, where m is a positive integer, is preferably used. More preferably m=1, that is, titanium monoxide (TiO) is used. This is because TiO shows blackness superior to that of other types of TiOn, has a fine particle diameter of 0.03 to 0.2 μm, and is effectively dispersed in rubber or resin. In addition, when TiO is used while being dispersed in a coating, a smooth coated surface can be obtained.

In this invention, the above reduced titanium oxide is dispersed in the matrix to form the outermost resistance layer. Preferably, a material of high resistance, such as a resin or rubber material, is used as the matrix.

Acrylic resin, such as polyurethane, polymethly methacrylate or polybutyl methacrylate; polyvinyl butyral; polyvinyl acetate; polyarylate; polycarbonate; polyester; phenoxy resin; polyvinyl acetate; polyamide; polyvinyl pyridine; or cellulosic resin is used as the resin material for use as the matrix.

Rubber, such as ethylene-propylene-diene terpolymer (EDM), polybutadiene, natural rubber, polyisoprene, styrene-butadiene rubber (SBR), chloroprene rubber (CR), acrylonitrile-butadiene rubber (NBR), silicone rubber, urethane rubber, or epichlorophydrin rubber; polybutadiene-type resin (RB); thermoplastic elastomer, such as polyolefine system thermoplastic elastomer, polyester system thermoplastic elastomer, polyurethane system thermoplastic elastomer, PVD or polystyrene system thermoplastic elastomer like styrene-butadiene-styrene elastomer (SBS); or a polymeric material, such as polyurethane, polystyrene, polyethylene (PE), polypropylene (PP), polyvinyl chloride (PvC), acrylic resin, styrene-vinyl acetate copolymer or butadiene-acrylonitrile copolymer, can be used as the rubber material.

Li, TCNQ, ions of $AsF_5$, $I_2$, $Br_2$, $SO_3$, Na, K, $ClO_4$, $FeCl_3$, F, Cl, Br, I, or Kr are used as a dopant, and doped into a substance, such as polyacetylene, poly (p-phenylene), polypyrrole, polythiophene, poly (p-phenylene oxide), poly (p-phenylene sulfide), poly (p-phenylenevinylene), poly (2,6-dimethylphenylene oxide), poly (bisphenol·A carbonate), polyvinylcarbazole, polydiacetylene, poly (N-methy-4-vinylpridine), polyaniline, polyquinoline, or poly (phenylene ether sulfone). Such a substance is used as a host polymer of an electrically-conductive high polymer molecule.

A substance, such as $LiClO_4KSCN$, NaSCN, LiSCN or $LiCF_3SO_3$, which is used as an additive, is added to polymethyl methacrylate, dimethyl siloxane-ethylene oxide copolymer, polyethylene oxide, poly (β-propiolactone), poly (propylene oxide), polyvinylidene fluoride, or poly (N-methylethyleneimine), one of which latter substances may also be used as the host polymer. Boron polymer may also be effectively used as the host polymer.

A device, such as a roll kneader, a Banbury mixer, a ball mill, a sand grinder or a paint shaker, can be used for dispersion.

An inner resistance layer is formed by dispersing electrically-conductive particles in an elastic material such as resin.

Carbon black, metallic oxide, metallic powder, etc. are used as the electrically-conductive particles.

Preferably, an elastic material is formed by dispersing carbon black having an oil absorption of 80 ml/100 g (JIS K6221) in a silicone rubber. In particular, this material is used as the inner resistance layer for the following reasons: when two resistance layers are formed, electrically-conductive particles, such as carbon black, graphite or metallic powder, are dispersed in the elastic material, such as rubber or resin, in order to provide the inner resistance layer with electrical conductivity. However, when the electrically-conductive particles are dispersed, the hardness of the elastic material inevitably increases It is desirable that the hardness of the charging member be low so as to allow the member to come into complete contact with a photosensitive member. A softener, such as oil or a plasticizer, is generally added to reduce the hardness of the charging member.

Softeners such as oil and plasticizers, however, have undesirable transfer characteristics. Consequently, when they bleed from the surface of the charging member, they can contaminate the photosensitive member or may cause the toner to fix. It is therefore desirable that the amount of the softener added be as small as possible.

To this end, a highly electrically-conductive filler is employed which is capable of reducing the resistance, even when a small amount of filler is used. By reducing the amount of filler blended, the hardness of the inner resistance layer is decreased, thereby reducing the amount of softener added.

The resistance value required for the charging member ranges from approximately $10^4$ to $10^9$ Ω. It is difficult to control the required resistance value in such a region by adding the highly electrically-conductive filler, thus increasing variations in the resistance value of the production lots. A vinyl group is one of the organic groups, such as a methyl group, a phenyl group and a 3,3,3-trifluoropropyl group, in a material polymer which is organopolysiloxane. The vinyl group is directly related to crosslinking. However, when the silicone rubber is used, a small number of phenyl groups is added, or the number of vinyl groups is decreased, and therefore the number of crosslinking points is decreased. In this way, it is possible to obtain low hardness in a wide temperature region without employing a softener such as oil.

Preferably, 0.05 to 0.005 wt % vinyl group is contained in dimethylpolysiloxane.

In such a case, even if large amounts of carbon black having small oil absorption are added, a charging member of relatively low hardness can be obtained without adding a softener such as oil. Even if a softener is added, an extremely small amount suffices; generally, not more than 20 parts by weight of the softener is sufficient for 100 parts by weight of silicone rubber. Preferably, the oil absorption of the carbon black to be used is not more than 80 ml/100 g (JIS K6122).

Because the structure of carbon black (chain carbon black structure) with small oil absorption does into develop well, it has electrical conductivity inferior to that of carbon black having large oil absorption. Therefore, when the same amount of carbon black having small oil absorption is added to the same amount of carbon black having large oil absorption, an elastic material can be obtained which has stable resistance in the region of a relatively high resistance value. This is because the resistance value of carbon black, having inferior electrical conductivity, hardly varies. Such variations are caused by slight differences in the manner in which the carbon black is dispersed in the silicone rubber. Since carbon black absorbs only a small amount of oil, it has little reinforcing effect with respect to the polymer. Even when the amount of carbon black to be added is increased, the harness is not increased too much. This is because carbon black of small oil absorption has a small exposed surface area per unit weight, is crosslinked with the silicone rubber, and has few active points on the surface. The active points increase the harness of the silicone rubber.

Carbon black having small oil absorption is employed to increase the resistance of the inner resistance layer to some extent. When voltage is applied to the electrically-conductive substrate, the electric potential of the inner resistance layer falls greatly, thus decreasing an electric potential applied to the outer resistance layer. Consequently, leakage will not occur, even if the thickness of the outer resistance layer varies to some degree and it is thin. It is not necessary to add a softener, such as oil, but even if it is added, a small amount is sufficient. It is also not necessary to thicken the outer resistance layer so as to prevent the softener from bleeding. The thickness of the outer resistance layer can be reduced and various coating techniques can be employed. Preferably, the silicone rubber, which is used for forming the inner resistance layer and has the electrically-conductive particles dispersed in it, has a resistivity of $10^3$ Ω or more from the viewpoint of preventing leakage on the surface to be charged, and of $10^7$ Ω or less from the viewpoint of uniform charging. Preferably the hardness of the inner resistance layer is 20 degrees or more because it moves as the outer resistance moves and adheres to it, and also it is 40 degrees or less so that there is nip-width with respect to the surface to be charged. Desirably, the thickness of the outer resistance layer is 5 to 100μ, and that of the inner resistance layer is 1 to 10 mm. Also desirably, the thickness of the inner resistance layer is 10 to 200 when that of the outer resistance layer is regarded as 1.

When an ordinary unvulcanized rubber material is used to form a resistance layer in which an additive, such as carbon black, is dispersed, the resistance layer has great plasticity. For this reason, when a charging member of a roll shape is formed, the resistance value of the member varies from portion to portion, that is, a so-called irregular resistance is likely to occur. In other words, during injection molding or transfer molding in which the rubber material is cast into a pipe, when it is poured into the pipe and the gate is added, it receives compressive stress and therefore hardens quickly because of the heat. The resistance of a portion near the gate increases, causing irregular resistance. Internal stress, which is caused when the rubber material is poured into the pipe, remain, so that crosslinking reaction is promoted at a stress concentrator. The resistance value of the stress concentrator increases, causing irregular resistance. However, silicone rubber which has not been vulcanized possesses an extremely small plasticity of 120 to 200 (mm×100) (JIS C2123) when carbon black or the like is added. Irregular resistance does not occur, and the silicone rubber can be pipe-molded. It is thus possible to perform molding that does not require the process of grinding, and to produce a low-cost charging member with nor irregular resistance.

The amount of carbon black added is preferably 15 to 40% by weight.

An organopolysiloxane raw rubber in the silicone rubber composition, used for the inner resistance layer, is a straight-chain diorganopolysiloxane high polymer which is usually represented by the following general formula:

$$R''aSiO_{4-a/2}$$

where R'' is a methyl group, a vinyl group, a phenyl group or a 3,3,3-trifluoropropyl group, and at least 50 mol % of all organic groups is the methyl group, "a" ranging from 1.978 to 2.05.

Dimethylsiloxane, methylphenylsiloxane, diphenylsiloxne, methylvinylsiloxane, phenylvinyldiloxane, methyl 3,3,3-trifluoropropylsiloxane, etc. are used as a unit constituting diorganopolysiloxane.

The polymerization degree of diorganopolysiloxane is not limited and is usually on the order of several thousand to ten thousand.

Diorganopolysiloxane may be the unit of a monopolymer or a copolymer mentioned above or a mixture of these substances.

It is preferably to use a substance at least 50 mole % of all organic groups of which substance constitutes a methyl group. A small amount of the unit of $R''SiO_{1.5}$ (in which R'' represents the same group as that described above) may be contained in the structure of such a substance. The end of the molecular chain of the structure may be a hydroxyl group, and alkoxyl group, a trimethylsilyl group, a dimethylvinylsilyl group, a methylphenylvinylsilyl group, or a dimethylphenylsilyl group.

A crosslinking agent a reinforcing filler (such as fused or wet silica) and an additive usually used for raw silicone rubber may be blended beforehand with the raw diorganopolysiloxane rubber.

Preferably, organic peroxide is used as a crosslinking agent, and includes, for example, benzoylperoxide, 2,4-dichlorobenzoylperoxide, tertiarybutylperbenzoate, ditertiarybutylperoxide, dicumylperoxide, 2,5-dimethyl-2, 5-di (tertiarybutylperoxy) 2,5-dimethylhexane, dialykylperoxide, 1,1-di (tertiarybutylperoxy) 3,3,5-trimethylcyclohexane, etc. The appropriate selection of the type of crosslinking agent depends upon the type of rubber to be used. Preferably, it is added in an amount ranging from 0.1 to 15 phr.

A flame-retardant, a foaming agent, an agent for improving adhesion, and other substances may also be blended arbitrarily with the silicone rubber in addition to diatomaceous earth; carbon black; metallic oxides, such as calcium carbonate, zinc oxide and titanium dioxide; low-molecular alkoxypolydimethylsiloxane; diphenylsilandiol; trimethylsilano; and a well-known compound, that is, silica, such as fused and wet silica, which is usually blended with the silicone rubber.

An adhesive may appropriately be employed to improve the bond strength between the inner and outer resistance layers. In such an instance, the resistance value of the charging member may vary due to the resistance value of the adhesive.

When the inner and outer resistance layer are chemically bonded together with the aid of a silane coupling agent, these layers can be bonded within a thickness of a monomolecular layer. Satisfactory adhesion properties can thus be obtained without affecting the electrical resistance.

When a polymer is employed which has been polymerized by a silane coupling agent through dealcohol condensation between—OR or —OCR molecules, advantages such as those described below can be obtained. The silane coupling agent is represented by the following general formula:

$$XSi(OR)_3$$

where X is a functional group, such as an amino group, a vinyl group, an epoxy group, a mercapto group or a chloro group, which is reacted with an organic group, and R is a hydrolyzable group, such as a methoxyl group or an ethaxyl group.

When the outer resistance layer is formed by dipping for example, the silane coupling agent dissolves in a coating fluid which may cause poor adhesion. However, when the polymer is employed, the silane coupling agent does not migrate, and those does not contaminate the drum. Also, the solubility of the coupling agent in the coating fluid decreases, thus making it possible to form the outer resistance layer by a coating method such as disposing.

The thus-formed charging member is employed for various electrophotographic devices in the present invention.

FIG. 1 is a cross-sectional view which schematically shows the structure of an electrophotographic device using a charging member of this invention.

Numeral 1 denotes an image carrier serving as a member to be charged. It is a drum-type electrophotographic photoreceptor composed of an electrically-conductive substrate layer 1*b* made of a substance, such as aluminum, and a photoconductive layer 1*a* formed on the layer 1*b*. The photoreceptor 1 is rotatively driven at a predetermined peripheral speed on the supporting shaft 1*d* in a clockwise direction as viewed in FIG. 1.

Numeral 2 denotes a charging member which comes into contact with the surface of the photoreceptor 1. It uniformly and primarily charges the surface of the photoreceptor 1 so that the photoreceptor 1 assumes predetermined polarity and electrical potential. A roller-type charging member is employed in this embodiment and is hereinafter referred to as a charging roller. The charging roller 2 is composed of a core bar 2*c*, an inner resistance layer 2*b* formed on the outer periphery of the bar 2*c*, and an outer resistance layer 2*d* formed on the outer periphery of the layer 2*b*. Both ends of the core bar 2*c* are rotatably supported by bearing members (not shown). The charging roller 2 is situated parallel to the drum-type photoreceptor 1, and is pressed into contact with the surface of the photoreceptor 1. Such contact is carried out with a predetermined pressing force by pressing means (not shown), such as a spring. As the photoreceptor 1 is rotatively driven, the charging roller 2 is rotated.

A DC bias or DC and AC biases are applied from a power source 3 to the core bar 2*c* through a sliding electrode 3*a*, whereby the surface of the photoreceptor 1 is charged and assumes a predetermined polarity and electrical potential.

The surface of a photoreceptor 1, which has been uniformly charged by the charging roller 2, is subjected by exposure means 10 to exposure, such as laser beam scanning exposure or slit exposure of an original image. Such exposure is used to gain information regarding a target image. Thereby, an electrostatic latent image corresponding to the information regarding the target image is formed on the surface of the photoreceptor 1. The latent image is then formed by developing means 11 into a visible image, which is a toner image.

The toner image is then transferred onto a transfer member 14 which is carried by transfer means 12 from paper feeding means (not shown). The transfer member 14 is carried between the photoreceptor 1 and the transfer means 12 in proper timing and synchronism with the rotation of the photoreceptor 1. The transfer means 12 is a transfer roller. The reverse surface of the transfer member 14 is charged with a polarity opposite to that of the toner, whereby the toner image on the surface of the photoreceptor 1 is transferred onto the transfer member 14. When the charging means of this invention is used as this transfer means, a stable surface layer can be formed in a semiconductive region because $Ti_nO_{2n-1}$ is dispersed in the outer resistance layer. Thus, when a cleaning bias voltage, which is used for transferring the toner adhering to the charging means onto the side of the photoreceptor, is applied to the charging means, it is readily possible to discharge the charge of the toner with an opposite polarity. As a result, an image free from scattering and contamination on the back thereof can be obtained. Even after long use of the roller, the surface of the roller does not become contaminated. The photosensitive member is charged with a polarity opposite to that of the remaining charge so as to offset it.

The transfer member 14, onto which the toner image has been transferred, is moved from the surface of the photoreceptor 1 to image fixing means so as to fix the toner image. The transfer member 14 is then output. If another image is formed on the reverse surface of the transfer member 14, the transfer member 14 is carried to re-carrying means which carries it again to a transfer portion.

After the image has been transferred, the surface of the photoreceptor 1 contaminated by the remaining toner is cleaned by cleaning means 13 and is again used for forming images.

The charging member 2 may also be formed into various shapes, such as a blade, a block, a rod and a belt, in addition to the roller shape used as means for charging the image carrier 1 in the image forming apparatus shown in FIG. 1.

The roller-type charging member 2 may be either stationary or driven as the image carrier 1, which is the member to be charged, is rotated. It may be rotatively driven at a predetermined peripheral speed in the same direction as that in which the image carrier is rotated or in the reverse direction.

A plurality of components of the electrophotographic device, such as the photoreceptor, the developing means and the cleaning means, may be combined together into a unit which is detachably attached to the device. For instance, a unit may be constructed in which at least one of the charging, the developing and the cleaning means is supported together with the photoreceptor. This unit is detachably attached with the aid of a rail to the electrophotographic device. The remaining one or two means may also be included in the unit.

When the electrophotographic device is used as a copying machine or a printer, exposure turns a signal representing a manuscript into a reading signal or turns light reflected from or being transmitted through the manuscript into the signal. This signal performs laser beam scanning and operates an LED or a liquid crystal shutter array.

Figure 2:
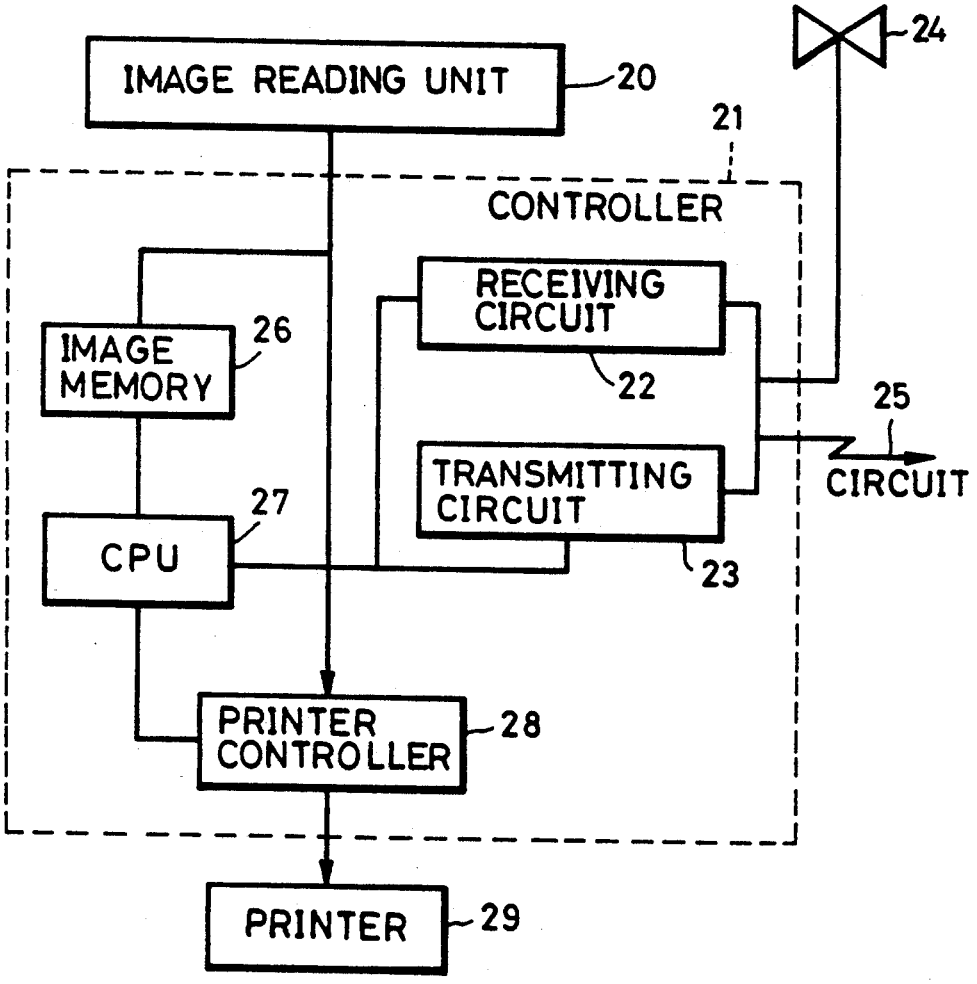
FIG. 2 is a block diagram of a facsimile device employing the above-mentioned electrophotographic device as a printer.

When the electrophotographic device is used as a facsimile device, exposure is employed for printing data received. FIG. 2 is a block diagram shown such a device.

In FIG. 2, a controller 21 controls an image reading unit 20 and a printer 29. A CPU 27 controls the entire controller 21. Reading data is transmitted from the image reading unit 20 to a distance station via a transmitting circuit 23. Data received from the distance station is transmitted to the printer 29 through a receiving circuit 22. Predetermined image data is stored in an image memory 26. A printer controller 28 controls the printer 29. Numeral 24 denotes a telephone set.

The receiving circuit 22 first demodulates an image (image information) received from a remote terminal connected through a circuit 25. The CPU 27 then decodes the image information and stores it in the image memory 26. When an image of an amount equal to at least 1 page is stored in the image memory 26, the image on that page is recorded. The CPU 27 reads from the memory 26 the image information from an amount equal to 1 page, and transmits composed image information to the printer controller 28. When the printer controller 28 receives from the CPU 27 the image information of an amount equal to 1 page, it controls the printer 29 so as to record the image information.

While the printer 29 is performing recording, the CPU 27 receives the next page.

In this way, the image is received and recorded.

The electrophotographic photoreceptor is constructed in the following manner.

A photosensitive layer is formed on an electrically-conductive base. A substance having electrical conductivity in itself, such as aluminum, aluminum alloy, stainless steel or nickel, may be used as the electrically-conductive base. In addition, plastic may also be used as the base, which plastic has a electrically-conductive binder or a layer on which a film is formed by vapor-depositing aluminum, aluminum alloy, or indium oxide-tin oxide alloy. Electrically-conductive particles, such as carbon black or tin oxide particles, together with an appropriate binder, are applied onto a metal or plastic, which may also be used as the base.

An undercoat having barrier and bonding properties can be formed between the photosensitive layer and the electrically-conductive base. The undercoat may be formed of a substance, such as casein, polyvinyl alcohol, nitrocellulose, ethylene-acrylic acid copolymer, polyamide (nylon 6, nylon 66, nylon 610, copolymer nylon, etc.), polyurethane, gelatin, and aluminum oxide. The thickness of the undercoat is not more than 5 μm, and preferably, 3 to 5 μm. The volume resistivity of the undercoat is preferably not less than $10^7$ Ω·cm.

The photosensitive layer can be formed by vapor depositing or applying an organic or inorganic photoconductor together with a binder as required.

The photosensitive layer is preferably a functional separation type having a charge generating layer and a charge transporting layer.

The charge generating layer can be formed by vapor-depositing a substance which generates charge, such as an azo pigment, a phthalocyanine pigment, a quinone pigment, and a perylene pigment. Alternatively, it can be formed by applying such a charge generating substance together with or without an appropriate binder resin.

The thickness of the charge generating layer is preferably 0.01 to 5 μm, and more preferably, 0.05 to 2 μm.

A substance, such as a hydrazone compound, a styryl compound, an oxazole compound and a triarylamine compound, which transports charge is dissolved in a binder resin having properties to form a film. Thereby, the charge transporting layer can be formed.

The thickness of the charge transporting layer is preferably 5 to 50 μm, and more preferably, 10 to 30 μm. A protective layer may be provided on the photosensitive layer to prevent the latter layer from deteriorating due to ultraviolet rays and the like.

The present invention will be described below in more detail with reference to Examples.

EXAMPLE 1

100 parts of organopolysiloxane raw rubber, whose molecular weight is one million, which is dimethylpolysiloxane, containing 0.03 wt % vinyl group; 30 parts of carbon black shown in Table 1; and 1.5 parts of 2.5 dimethyl, 2.5 di(t-butylperoxy) hexane (50% paste) were kneaded by two rolls until these substances were dispersed uniformly. A transfer molding method was employed to pour the rubber into a pipe mold having a stainless steel-made core bar onto which a primer was applied. The rubber was first vulcanized for 20 minutes, at 170° C. and under 200 kg/cm$^2$. After the pipe had been cooled, the rubber was removed from the mold, and then vulcanized in a hot air oven for 4 hours at 200° C. In this way, the inner resistance layer was formed. A this time the core bar was 250 mm in length, 6 mm in inside diameter, and 12 mm in outside diameter. The rubber was 240 mm in length.

TABLE 1

| Type | Oil Absorption | Trade Name (Columbian Carbon) |
|---|---|---|
| A | 50 | RAVEN #760 |
| B | 70 | #850 |
| C | 80 | #430 |
| D | 103 | #790 |
| E | 125 | CONDUCTEX #900 |

Next, polyurethane (trade name: E185 manufactured by Nihon Miractran Co., Ltd.) was dissolved in a mixed solvent, the solid content of which was 10%, of DMF and toluene. 7 wt % titanium monoxide (trade name: Titan Black manufactured by Mitsubishi Material Co., Ltd.), serving as electrically-conductive particles, was added to the solvent which was dispersed by a sand grinder until it became uniform. Thereby, a coating medium was obtained.

This coating medium was applied by dipping of the above two rollers, and dried for 20 minutes at 120° C. Thus, the outer resistance layer having approximately 20 μm was formed. The color of the outside of the rollers was black. The resistance value of the rollers was measured in the following manner.

Figure 3:
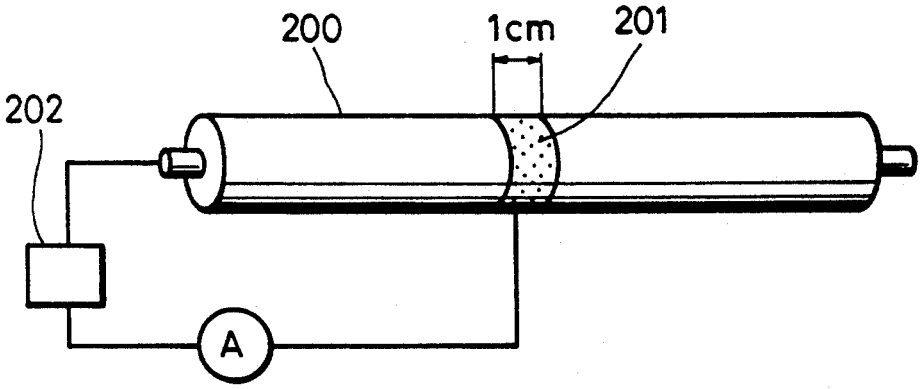
FIG. 3 is a view illustrating a method of measuring the resistance of resistance layers of a charging roller.

As shown in FIG. 3, an aluminum foil 201 having a width of 10 mm was wound around a roller 200 to be measured A direct current of 1 kV was applied from a power source 202 to the aluminum foil 201 and the core bar. The electric current and the resistance value between the aluminum foil 201 and the core bar were measured. Pressure was applied perpendicularly to the axis of the roller 200. A hardness meter JISA mentioned in JIS K6301 was utilized to measure the hardness of the roller 200. Table 2 shows the results of such measurements.

TABLE 2

| Type | Volume Resistivity after Application | Hardness of Roller after Application |
|---|---|---|
| A | $5 \times 10^7\ \Omega$ | 26 |
| B | $1 \times 10^6\ \Omega$ | 28 |
| C | $2 \times 10^5\ \Omega$ | 30 |
| D | $6 \times 10^4\ \Omega$ | 33 |
| E | $1 \times 10^4\ \Omega$ | 40 |

The thus-manufactured roller, which was a charging roller, was set in the device shown in FIG. 1. Voltage was applied from the power source 3 to the charging roller 2 under the following conditions: an AC frequency was 150 Hz, an AC peak voltage was 2 kV, a DC voltage was 700V, and the speed at which the photoreceptor processes was 25 mm/sec. The charge characteristics were evaluated under such conditions.

A pinhole having a diameter of approximately 0.5 mm was formed in the photoreceptor, and a test was conducted to examine whether the inner and outer resistance layers of the charging roller broke down due to electric current leakage when the charging roller comes into contact with the pinhole. The test was performed in an environment where the temperature was 23° C. and RH was 50%. Table 3 shows the results of the test.

TABLE 3

| Type | Charge Characteristics | Breakdown due to Leakage of Electric Current |
|---|---|---|
| A | ○ | ○ |
| B | ○ | ○ |
| C | ○ | ○ |
| D | ○ | X |
| E | Poor charge at some portions | X |

where

"O" indicates no breakdown occurs due to leakage of the electric current, and

"X" indicates that such a breakdown occurs, damaging the outer resistance layer.

The photoreceptor employed in this test was formed in the following manner.

An aluminum cylinder, serving as a base, which had a thickness of 0.5 mm and 40ϕ×260 mm was prepared.

4 parts of a copolymer nylon (trade name: CM8000 manufactured by Toray Industries, Inc.) and 4 parts of a type 8 nylon (trade name: Luckamide 5003 manufactured by Dainippon Ink and Chemicals, Inc.) were dissolved in 50 parts of methanol and 50 parts of n-butanol. The solution was applied onto the above base to form a polyamide undercoat having a thickness of 0.6 μm.

10 parts of bisazo pigment represented by the following structural formula, 10 parts of polyvinylbutyral (Slex BM2 manufactured by Sekisui Chemical Co., Ltd.), together with 120 parts of cyclohexanon, were dispersed by a sand mill for 10 hours. 30 parts of methyl ethyl ketone was added to the fluid dispersions, and applied to the undercoat. Thus the charge generating layer having a thickness of 0.15 μm was formed.

[Chemical Formula 1]

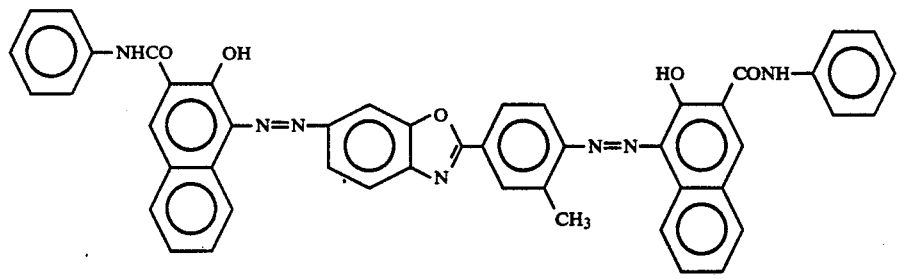

10 parts of polycarbonate Z resin, weight-average molecular weight of which resin is 120000, (manufactured by Mitsubishi Gas Chemical Co., Inc.) was prepared, and it, together with 10 parts of a hydrazone compound represented by the following structural formula, was dissolved in 80 parts of monochlorobenzene.

[Chemical Formula 2]

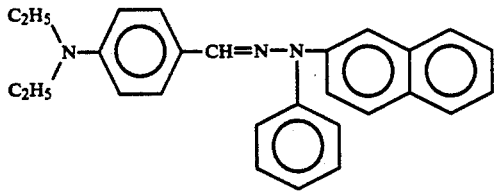

The solution was applied to the charge generating layer to a thickness of 18 μm. The photoreceptor was thus formed.

The same tests as those described above were conducted in an environment where the temperature was 32.5° C. and RH was 85% (i.e., the temperature and RH were both high) and where the temperature was 15° C. and RH was 10% (i.e., the temperature and RH were both low). The same results as those mentioned above were obtained.

When a durability test was performed by feeding 100,000 sheets of paper in an environment where the temperature and RH were high as well as low, there was no performance problem. After the durability test had been completed, the outside of the roller was clean.

The rollers A to E (Tables 1 through 3) were pressed into contact with the organic photoreceptor mentioned previously under a total load of 1 kgf and at a temperature of 32.5° C. and a R.H. of 85%, and left for 1 week. Then, contamination of the photoreceptor was evaluated. No contamination which appeared to be caused by the migration of a substance from inside the rollers was detected the from any of the rollers A to E.

COMPARATIVE EXAMPLE 1

Type B shown in Table 1 was used as an inner resistance layer. The charge characteristics and breakdown due to the leakage of the electric current were examined in the same manner as that in Example 1, except that 1.5 wt % carbon black (trade name: Conductex 975 manufactured by Columbian Carbon Japan Ltd.) was used as an outer resistance layer. The resistance value of the roller was $1\times10^6$ Ω, and the hardness thereof was 28 degrees (JISA).

The same results as those in Example 1 were obtained in an environment where the temperature was 23° C. and RH was 50% and the temperature and RH were both low. However, in an environment where the temperature and RH were both high, the resistance value of the outer resistance layer fell, and breakdown due to the leakage of the electric current occurred with respect to pinholes in the drum.

The charge characteristics and breakdown due to the leakage of the electric current were examined in the same manner as that in Comparison Example, except that 7 wt % electrically-conductive titanium oxide (trade name: ET-500W manufactured by Ishihara Sangyo Kaisha, Ltd.) was used as the electrically-conductive particles in the outer resistance layer. The color of the outside of the roller was white. The resistance value of the roller was $1\times10^6$ Ω, and the hardness thereof was 28 degrees (JISA).

The same satisfactory test results as those in Example 1 were obtained in an environment where the temperature and RH were high as well as low. However, when a durability test was conducted by feeding 100,000 sheets of paper, filming of the toner occurred. After the durability test had been completed, the outside of the roller showed contamination caused by the adhesion of the toner and like.

COMPARATIVE EXAMPLE 2

A transfer roller was produced which had the same structure as that of the charging member 2, that is, the transfer roller had a core bar, an inner resistance layer formed on the outer periphery of the bar, and an outer resistance layer formed on the outer periphery of the inner resistance layer. The transfer roller was used as the transfer means 12 shown in FIG. 1. The inner resistance layer was a foamed EPDM rubber layer, Electrically-conductive zinc oxide as employed as electrically-conductive particles. Such a transfer roller was allowed to stand for one week in an environment where the temperature was 23° C. and RH was 60%. The total resistance value of the core bar and the inner resistance layer was $1\times10^{11}$ Ω·cm when it was measured in the following manner.

An electrically-conductive rubber sheet having a width of 10 mm, a thickness of 1.5 mm and a volume resistance of $10^{1-2}$ Ω·cm was wound around the outer periphery of the roller. A voltage of 1 kV was applied between the core and the electrically-conductive rubber sheet. The resistance was measured and then converted to a volume resistance.

The roller was 20 mm in diameter and 230 mm in length. Polyurethane (trade name: E185 manufactured by Nihon Miractran Co., Ltd.) was dissolved in a mixed solvent, the solid content of which was 10%, of DMF, toluene and MEK. 50 wt % titanium monoxide (trade name: Titan Black manufactured by Mitsubishi: Material Co., Ltd.), serving as electrically-conductive particles, was added to the solvent which was dispersed by a sand grinder until it became uniform. A coating medium was thereby obtained This coating medium was applied to the roller by dipping, and then hardened by heat for 10 to 20 minutes at 120° to 150° C. The coating medium was formed on the outer resistance layer. The thickness of the outer resistance layer was, on the average, approximately 5 μm.

The speed at which the photoreceptor processed was 60 mm/sec. The diameter of the photosensitive drum was 60 mm.

The photosensitive member was negatively charged, whereas the toner was positively charged. A voltage of −4.5 kv was applied to the transfer roller during a transferring operation, and a voltage of +1.5 kV was applied to it during a cleaning operation.

When the above-described roller was utilized to produce a line image, an all-black image, and a half-tone image, all clear images were obtained.

An A4-sized, all-black sheet of paper was used as a manuscript; a cleaning bias voltage was applied when no paper was fed; and a transfer bias voltage was applied while paper was being fed. Under such conditions, 50 sheets of A5-sized paper were fed and copied in succession, and then one A4-sized sheet of paper was fed to evaluate contamination on the back of an image. An image was obtained which had substantially no contamination due to the toner or problems in terms of practical use. Also, after 50 sheets of paper were copied in succession, contamination was evaluated for a transfer guide, which was made of metal and to which a voltage of −500V was applied. There were no problems in terms of practical use. In addition, a durability test was performed by feeding 200,000 sheets of paper. After the test was completed, the outer resistance layer did not show contamination due to the adhesion of the toner.

What is claimed is:

1. A charging member comprising:

at least two resistance layers in which electrically-conductive particles are dispersed, these two resistance layers being formed on an electrically-conductive substrate, the electrically-conductive particles dispersed in a matrix of an outer resistance layer being reduced titanium oxide represented by the following general formula:

TiOn where n is a number not more than 1.9.

2. A charging member according to claim 1, wherein the ratio of the number of atoms of titanium to the number of atoms of oxygen in the general formula TiOn is not larger than 1:1.

3. A charging member according to claim 1, wherein the electrically-conductive particles are titanium monoxide.

4. A charging member according to claim 1, wherein an inner resistance layer is formed of a silicone rubber elastic member in which carbon black having an oil absorption of not more than 80 ml/100 g is dispersed.

5. A charging member according to claim 1, wherein the inner resistance layer comprises 15 to 40 wt % carbon black.

6. A charging member according to claim 1, wherein the hardness of the inner resistance layer is in the range of 2 to 40 degrees (JISA), and the resistance value of the inner resistance layer is $10^3$ to $10^7$ Ω.

7. A charging member according to claim 1, wherein a matrix of the inner resistance layer is dimethylpolysiloxane comprising 0.05 to 0.005 wt % vinyl group.

8. A charging member according to claim 1 further comprising a primer layer including a silane coupling agent between the resistance layers.

9. A charging member according to one of claims 1 to 8, adapted for transfer charge which transfers an image developed onto a transfer member.

10. A device in which at least one of developing means and cleaning means is supported integrally with charging means and a photosensitive member and is formed into a unit which is detachably attached to the device, wherein the charging means has at least two resistance layers on an electrically-conductive substrate, electrically-conductive particles dispersed in a matrix of an outer resistance layer being reduced titanium oxide represented by the following general formula:

TiOn where n is a number not more than 1.9.

11. A device according to claim 10, wherein the hardness of the inner resistance layer is in the range of 20 to 40 and the resistance value of the inner resistance layer is $10^3$ to $10^7$ Ω.

12. An electrophotographic device comprising:

a photosensitive member;

means for developing a latent image formed on latent image forming means; and means for transferring the developed image onto a transfer member, wherein at least one charging member, for supplying charge to the latent image forming means or for transfer-charging the developed image onto the transfer member, has at least two resistance layers on an electrically-conductive substrate, and wherein electrically-conductive particles dispersed in a matrix of an outer resistance layer are reduced titanium oxide represented by the following general formula:

TiOn were n is a number not more than 1.9.

13. An electrophotographic device according to claim 12, wherein the hardness of the inner resistance layer of the charging member is in the range of 20 to 40 degrees (JISA), and the resistance value of the inner resistance layer is $10^3$ to $10^7$ Ω.

14. A facsimile device comprising:

a photosensitive member;

means for forming a latent image;

means for developing the latent image formed; and means for transferring the developed image onto a transfer member, wherein at least one charging member, for supplying charge to the latent image forming means or for transfer-charging the developed image onto the transfer member, has at least two resistance layers on an electrically-conductive substrate, and wherein electrically-conductive particles dispersed in a matrix of an outer resistance layer are reduced titanium oxide represented by the following general formula:

TiOn where n is a number not more than 1.9.

15. A facsimile device according to claim 14, wherein the hardness of the inner resistance layer of the charging member is in the range of 20 to 40 degrees (JISA), and the resistance value of the inner resistance layer is $10^3$ to $10^7$ Ω.

* * * * *

UNITED STATES PATENT AND TRADEMARK OFFICE

CERTIFICATE OF CORRECTION

PATENT NO. : 5,270,768

DATED : December 14, 1993

INVENTOR(S) : Jun Murata

It is certified that error appears in the above-indentified patent and that said Letters Patent is hereby corrected as shown below:

COLUMN 3:

line 49, "(Ti/0 ratio)" should read --(Ti/O ratio)--.
line 65, "polymethly" should read --polymethyl--.

COLUMN 4:

line 16, "(PvC)," should read --(PVC),--.
line 26, "4-vinylpridine)," should read --4-vinylpyridine),--.
line 58, "increases" should read --increases.--.

COLUMN 5:

line 35, "into" should read --not--.
line 55, "harness" should read --hardness--.

UNITED STATES PATENT AND TRADEMARK OFFICE

CERTIFICATE OF CORRECTION

PATENT NO. : 5,270,768

DATED : December 14, 1993

INVENTOR(S) : Jun Murata

It is certified that error appears in the above-indentified patent and that said Letters Patent is hereby corrected as shown below:

COLUMN 6:

line 31, "remain," should read --remains--.
line 57, "phenylvinyldiloxane," should read --phenylvinylsiloxane,--.

COLUMN 7:

line 8, "agent" should read --agent,--.
line 28, "trimethylsilano;" should read --trimethylsilanol;--.
line 36, "layer" should read --layers--.
line 56, "dipping" should read --dipping,--.
line 65, "disposing." should read --dipping.--.

COLUMN 9:

line 50, "distance" should read --distant--.
line 51, "distance" should read --distant--.

UNITED STATES PATENT AND TRADEMARK OFFICE

CERTIFICATE OF CORRECTION

PATENT NO. : 5,270,768

DATED : December 14, 1993

INVENTOR(S) : Jun Murata

It is certified that error appears in the above-indentified patent and that said Letters Patent is hereby corrected as shown below:

COLUMN 10:

line 21, "of" should read --from--.

COLUMN 11:

line 2, "A" should read --At--.

COLUMN 12:

line 35, "Luckamide" should read --LUCAMIDE--.
line 41, "(Slex BM2" should read --(S-LEC BM2--.

COLUMN 13:

line 36, "the" (first occurrence) should be deleted.

UNITED STATES PATENT AND TRADEMARK OFFICE

CERTIFICATE OF CORRECTION

PATENT NO. : 5,270,768

DATED : December 14, 1993

INVENTOR(S) : Jun Murata

It is certified that error appears in the above-identified patent and that said Letters Patent is hereby corrected as shown below:

COLUMN 15:

line 44, "one of" should read --any one of--.

COLUMN 16:

line 6, "40" should read --40 degrees (JISA)--.

Signed and Sealed this

Thirtieth Day of August, 1994

Bruce Lehman

*Attest:*

BRUCE LEHMAN

*Attesting Officer*

*Commissioner of Patents and Trademarks*